United States Patent [19]

Stemmle

[11] Patent Number: 4,807,866

[45] Date of Patent: Feb. 28, 1989

[54] SHEET STACKERS

[75] Inventor: Denis J. Stemmle, Wester, N.Y.

[73] Assignee: Xerox Corporation, Stamford, Conn.

[21] Appl. No.: 943,520

[22] Filed: Dec. 17, 1986

[30] Foreign Application Priority Data

Dec. 17, 1985 [GB] United Kingdom ..... 8531030

[51] Int. Cl.[4] ..... B65H 31/00

[52] U.S. Cl. ..... 271/209; 271/212; 271/213; 271/180; 271/186

[58] Field of Search ..... 271/212, 213, 209, 207, 271/180, 177, 65, 163, 186, 245

[56] References Cited

U.S. PATENT DOCUMENTS

| | | | |
|---|---|---|---|
| 1,071,928 | 9/1913 | Koerner | 271/101 |
| 1,072,397 | 9/1931 | Koerner | 271/101 |
| 3,396,966 | 8/1968 | Solheim | 271/212 |
| 3,790,163 | 2/1974 | Helm | 271/165 |
| 3,915,447 | 10/1975 | Perno | 271/243 X |
| 3,951,401 | 4/1976 | Marass | 271/158 |
| 4,025,187 | 5/1977 | Taylor et al. | 271/245 X |
| 4,135,804 | 1/1979 | Schoppe et al. | 271/245 X |
| 4,174,831 | 11/1979 | Marass et al. | 271/159 |
| 4,696,465 | 9/1987 | Willi | 271/243 X |

FOREIGN PATENT DOCUMENTS

| | | | |
|---|---|---|---|
| 626263 | 2/1936 | Fed. Rep. of Germany | 271/177 |
| 187343 | 1/1964 | Sweden | 271/212 |
| 257733 | 11/1969 | U.S.S.R. | 271/212 |

OTHER PUBLICATIONS

IBM Technical Disclosure Bulletin, vol. 23, No. 11, Apr. 1981, "Cam-Lifting Device", by L. A. Walker.

*Primary Examiner*—Joseph J. Rolla
*Assistant Examiner*—David H. Bollinger
*Attorney, Agent, or Firm*—William A. Henry, II

[57] ABSTRACT

A device for stacking sheets, as from the outlet of a reprographic machine, uses a pair of belts having coplanar upper surfaces. The upper runs of the belts are stationary, and have a gap between them. To make the device work, the gap is displaced to one side of this stack and a sheet is fed into contact with that part of one belt which comes to lie below the stack, so that as the gap is translated across the bottom of the stack, the sheet is applied smoothly to the stack, displacing it upwardly.

8 Claims, 4 Drawing Sheets

SHEET STACKERS

This invention relates to sheet stackers, which are devices for successively adding individual sheets to a previously-compiled stack. Such devices are usually used in conjunction with a reproduction machine capable of long runs, and which usually delivers its copy sheets face side up, and in 1-to-N order. The stackers could also be used for long runs of multiple copies of the same document. The invention would facilitate unloading a partially-completed stack without disturbing the flow of copies.

In order to preserve this order in a stack of copy sheets, it is necessary either to invert each sheet and add it to the top of the stack, so that the order is preserved from the bottom up, or to add each sheet faceup to the bottom of the stack.

A number of ways for manipulating stacks of copy sheets have been taught in the past, for example, in U.S. Pat. No. 3,951,401 a fork-like stack changing table is arranged to support a residual stack and to be withdrawn when an auxiliary stack is raised up to it. Sealing strips seal the space between the stacks and the fork rods and means are provided for applying compressed air to the space between stacks to reduce friction when the table which supports the auxiliary stack is withdrawn. A device for inserting a new stack of sheet into a feeding position without interruption of sheet feeding is shown in U.S. Pat. No. 4,174,831 that includes a means for continuing the lifting of a residual stack while a table is lowered for loading a fresh stack of sheets. In U.S. Pat. No. 3,790,163 a device for feeding envelope blanks from the bottom of a stack is shown that includes the use of a feed cylinder to transport the bottom blank after separation from the stack to other transfer cylinders.

The present invention aims at overcoming the problem of having to lift a partially-compiled stack by suitable mechanical means in order to add a fresh sheet on the bottom of the stack, and accordingly provides a sheet stacker which is as claimed in the appended claims.

The present invention will now be described by way of example with reference to the accompanying drawings, in which.

Figure 1:
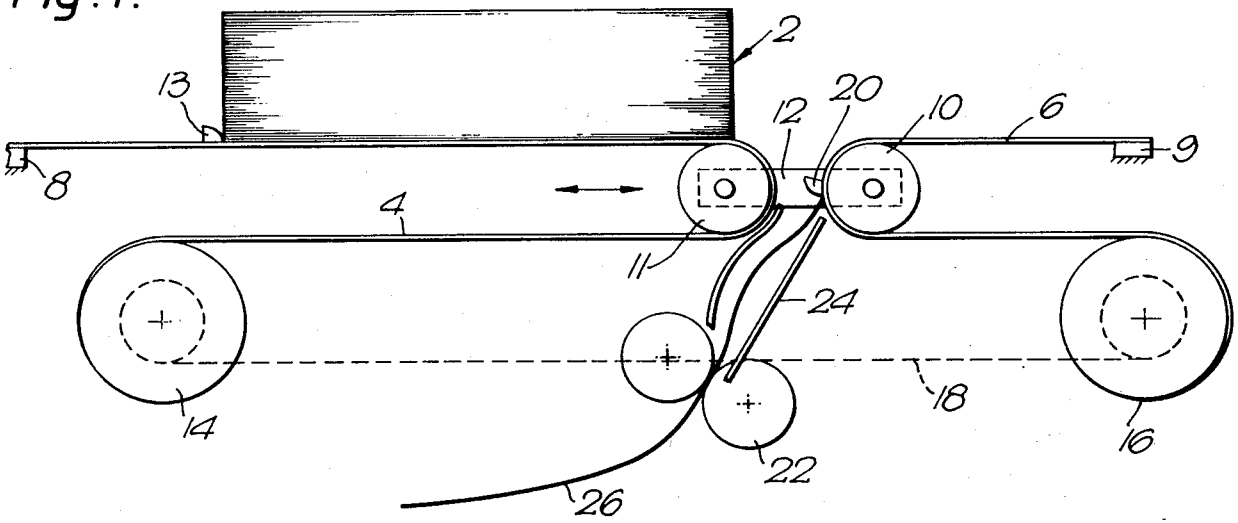
FIG. 1 is a diagrammatic side view of one form of sheet stacker of the present invention.

In the apparatus shown in FIG. 1, a partially-compiled stack of sheets 2 normally has its weight carried by the upper run of the left-hand one of a pair of belts 4 and 6, with the upper runs being coplanar and horizontal, although in some instances it might be preferable for the upper runs to be at an angle to the horizontal. At the end remote from the gap between the two belt runs, each belt is fixed to a stationary support 8 and 9, which ensures that the stack 2 is not translated during the stacking operation.

Each belt is entrained over the respective one of a pair of rollers 10, which are coupled together by a yoke 12 which holds the roller axes parallel to, and at a fixed distance from, each other. Means (not shown) are provided for reciprocating the pair of rollers 10 and 11 in parallel with the upper runs. The movable end of belt 4 is secured to a take-up roll 14, and the free end of belt 6 is likewise secured to roll 16. These may be coupled together, as indicated by the broken line 18, so that the rollers 10 and 11 may be reciprocated by driving roll 14 so as to take up length from the run of belt 4, and to allow roll 16 to let out an equivalent length of belt, so that the belt tension is not affected by horizontal movement of rollers 10 and 11.

Projecting upwardly from the upper surface of belt 6 is a stop 20 designed to function as a registration edge. Positioned below the feed gap provided by the spaced-apart portions of the belts is a sheet-feed mechanism comprising a pair of feed rollers 22, associated with which are guides 24 for limiting the maximum deflection of a sheet 26 being fed towards the stacker. The respective components are designed so that the sheet 26 is fed by rollers 22 until its lead edge comes into contact with the corner provided by the registration edge 20 and the adjacent part of the upper surface of belt 6. Feeding of the sheet continues for a short time after the lead edge has contacted the registration edge, thus producing a buckle in the sheet, which buckle is limited by the guides 24. This buckle ensures that when the pair of rollers starts to move to the left as viewed, the sheet remains in contact with the registration edge as it starts to move along the cycloidal path followed by the respective corner of registration edge 20.

Figure 5:
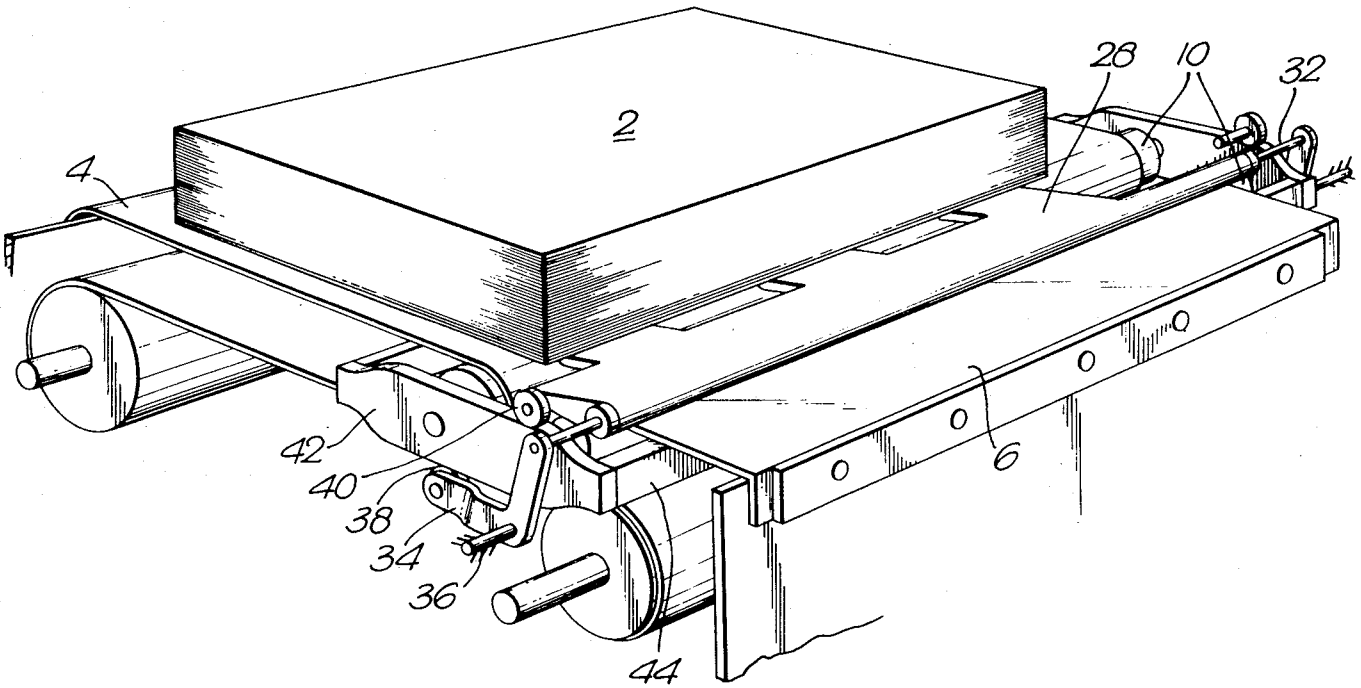
FIG. 5 is a diagrammatic perspective view of the essential components of a sheet stacker of the present invention.

Also shown in FIG. 5 is a pair of fingers 28 and 30 which are designed to pivot about axes which are fixed relatively to the location of the stack 2. The fingers are of such a length that their ends pass beneath and beyond the respective bottom corner of the stack and are designed to bear against that corner when operated, being permitted to do so by extending through appropriately-positioned slots in the belts 4 and 6, or else the belts themselves are narrower than the equivalent dimension of the stack, so that the ends of the stack overlie the belt edges. However, in practice it might be necessary to lift the stack, if at all, at several places along its corner so that the stack is not disturbed excessively during the stacking process.

The finger 28 is optionally provided to prevent the stack from being damaged as the gap between the rollers 10 moves across the bottom face of the stack. Because the belt 4 merely drops away from the bottom face of the stack as the pair of rollers 10 move to the left as viewed, and the belt 6 becomes lifted into contact with the same bottom face, although with the next sheet to be added applied to its upper surface, there might be only a slight danger of the sheet being damaged, by the sheets at the bottom of the stack having their edges curled down into the gap prior to be contacted by the successively-applied belt. Whereas this risk might well be negligible with 80 gsm and other relatively-stiff paper, the stack is intended to work with lighter papers, which would have a greater tendency to protrude downwardly into the gap and thus risk being impacted by the belt 6 at such an angle that the edges of the sheets become crumpled or otherwise damaged rather than being pressed smoothly back into contact with the rest of the sheets. When there is this danger, the finger 28 is operated to lift the respective stack edge when the apparatus shown in FIG. 1 is in the position shown, the force applied to finger 28 being sufficient either to lift that corner of the stack by a small amount or to contact it with sufficient force merely to stop the sheets from dropping downwardly into the gap until they are next contacted by belt 6. The stacker can also be designed with a second finger 28 (and its associated operating mechanisms) mounted in contact with the other side of the stack to prevent the bottom sheet from dropping downwardly into the gap when the gap moves below that side of the stack. The function and operation would be the same as already described.

The finger 28 can be dispensed with when the gap 12 is so small (c. 3 mm) that the risk of damage to the lead edges of the bottom sheets is negligible.

The fixed end of belt 4 is far enough to the left of the stack as viewed to permit the pair of rollers 10 and 11 to be moved sufficiently to the left for the above feed gap to be positioned to the left of the stack, with the weight of the stack being borne wholly by belt 6. That accounts for the provision of a second finger 28, which is operated in like manner to finger 28 of FIG. 5 when the pair of rollers 10 is being moved from the left-hand (duplex) position to the right-hand (simplex) position shown in FIG. 1.

The reason for the labelling of these two limit positions is as follows. The sheet 26 is intended to be fed to the stack 2 copy side up, so as to ensure that the desired 1-to-N order is preserved from the top of the stack. For this to happen, the simplex sheet 26 is supplied to the feed gap when the apparatus is positioned as shown in FIG. 1. However, when duplex sheets are to be supplied, it would be desirable to apply them with face N up and face 'N+1' down. To this end, the apparatus would be arranged to feed the lead edge of a duplex sheet into contact with a registration edge 13 projecting from belt 4, this being done when the feed gap is to the left (as viewed) of the stack. The pressing of the duplex sheet against the bottom face of the stack proceeds as described above with reference to simplex copies, with the only difference being that the pressing is effected while the rollers 10 are moving from left to right as viewed, motion in this direction inverting the sheet for stacking it with the stack order preserved.

As mentioned above, it will be appreciated that the path of the registration edge in space, i.e. relative to the stationary stack, is a cylcoid. It is therefore necessary for the registration edge to have a cross-section such that the upstanding part of the edge does not contact the side face of the stack as a new sheet is being pressed into contact with the bottom face of the stack. Ideally, the only contact would be with the corner at the bottom of the registration edge, it being that corner which determines the location of the lead edge of the next sheet to be added, and therefore the location of the respective side face of the stack, because all sheets have their positions dictated by the point at which the registration corner meets the plane containing the bottom face of the stack.

Figure 2:
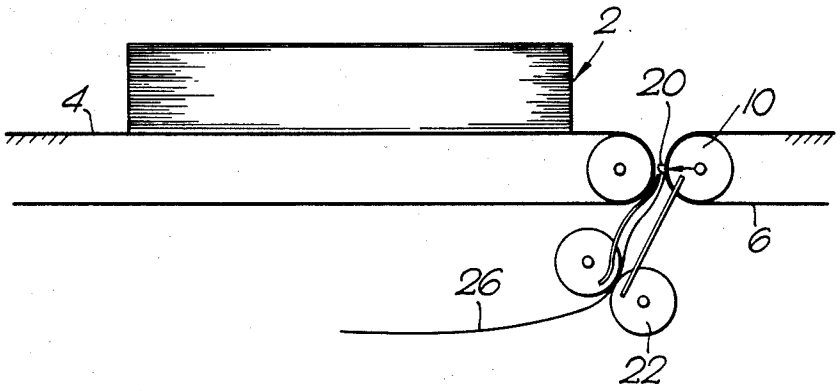
FIG. 2 is a more-diagrammatic view than FIG. 1 of the sheet stacker of this invention in its position just prior to the addition of a fresh sheet to the stack.
Figure 3:
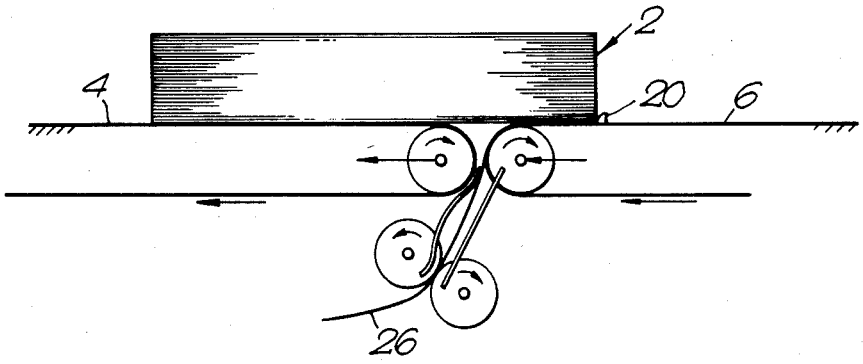
FIG. 3 is a view similar to FIG. 2 showing an intermediate stage of a fresh sheet being added.
Figure 4:
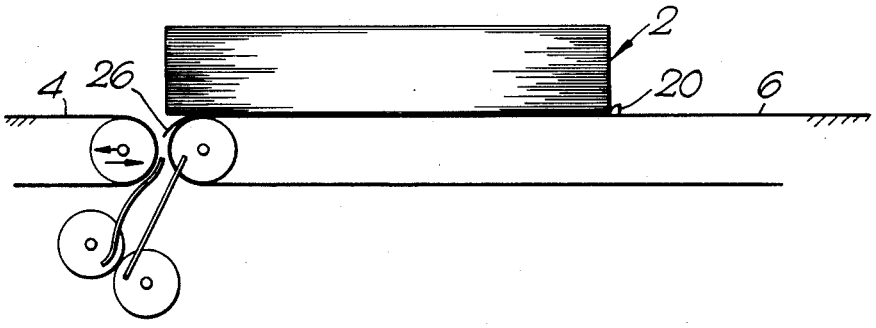
FIG. 4 is another view similar to FIG. 2 showing the final stages of a sheet addition.

Operation of the device shown in FIG. 1 is shown in the more-diagrammatic FIGS. 2–4. FIG. 2 shows the arrangement as shown in FIG. 1, with various components omitted for clarity. In these and other Figures, components already referred to will retain their original references. As shown in FIG. 2, the simplex copy sheet 26 has been fed by rollers 22 so that its lead edge has come into contact with registration edge 20 located in the feed gap between the rollers 10. As the rollers 10 start to move to the left as viewed, the buckle introduced into the lead portion of sheet 26 ensures that the lead edge itself remains in contact with the edge, with the rollers 22 being energised appropriately to ensure that the sheet 26 comes successively to lie on the upper face of belt 6 as the rollers 10 and 11 move to the left.

In the intermediate position shown in FIG. 3, the weight of the stack 2 is borne by both belts 4 and 6. As already mentioned above, as the belt 4 drops away from the bottom face of the stack 2, its place is taken by sheet 26 which is pressed upwardly into contact with the stack so as to press it progressively against the said bottom face until the position shown in FIG. 4 is reached, in which the trail edge of sheet 26 is just about to be pressed into place to form the bottom sheet of the stack.

If the sheet stacker of FIGS. 1-4 is also to be used for stacking duplex sheets, then the belt 4 would have a registration edge attached to it. Of necessity, when the rollers 10 reach the position shown in FIG. 4, the respective duplex registration edge (not shown) would have dropped away from the left-hand side face of the stack 2 and would have fallen into the feed gap between the rollers. If the same stacker can be used arbitrarily for stacking either simplex or duplex sheets, then the two registration edges have also to be shaped so that they do not interfere with the correct final application of a sheet to the bottom face of the stack. Alternatively, the registration edges could be designed to be selectively removable, so that the stacker has only one registration edge in position, dependent on whether the stacker is set for operating on simplex or duplex sheets. It is to be noted that the stack remains fixed, i.e. it is not translated, as sheets are being added.

FIG. 5 is a perspective view showing in greater detail how the finger 28 of FIG. 1 might be lifted automatically as the rollers 10 move to the left. The principal additions to FIG. 5 compared with the preceding Figures are the means for mounting and operating finger 28. The finger 28 takes the form of a longitudinally extending blade which is free to rotate about a rod 32 which extends between one arm of a pair of L- shaped levers 34, the levers having a fixed pivot 36. The other arm of lever 34 carries a roller 38 functioning as a cam follower.

Rotation of finger 28 about rod 32 is controlled by a roller 40 carried by the finger and similarly acting as a cam follower.

The essential part of the cam itself is a shaped bar 42 which acts as a double-edged cam, the bar itself being carried by cross-members 44 which are movable with the rollers 10.

FIG. 5 shows the sheet stacker at some time after the stacker has started to move to apply a fresh simplex sheet to the bottom face of stack 2. When in its previous limit position, the cam follower 40 was out of contact with the upper edge cam presented by bar 42, thus permitting the finger 28 to drop under gravity to a position in which the finger end is spaced vertically below the plane containing the bottom face of the stack. Also in this position, the cam follower 38 had come out of contact with the lower edge cam presented by bar 42, thus permitting the lever 34 to pivot in the clockwise sense as viewed to space the finger 28 to the right of the stack, as shown more clearly in FIG. 6. Thus the finger is sufficiently out of the way of the gap between the rollers 10 as not to interfere with the introduction of the lead edge of the next sheet 26 to be fed into the sheet stacker. After this has happened, and the rollers 10 start to move to the left as viewed, the cam follower 38 is the first to come into contact with the cam, thereby pivoting the lever 34 to move the cam so that the extremity of finger 28 comes to lie below the bottom corner of stack 2. Continued movement of the cam is effective to engage cam follower 40 and lift the finger 28 so that the respective parts thereof lift the bottom corner of the stack by an amount dictated by the profile given to the upper edge cam.

As the stacking motion continues, the belt 6 comes to lie below the bottom face of the stack, and in so doing lifts the finger 28, irrespective of the cam follower 40. As the cam continues to move, follower 38 drops off the respective cam and leads to the finger 28 being withdrawn from below the bottom face of the stack, leaving the stack sitting squarely on the belts 4 and 6.

Figure 6:
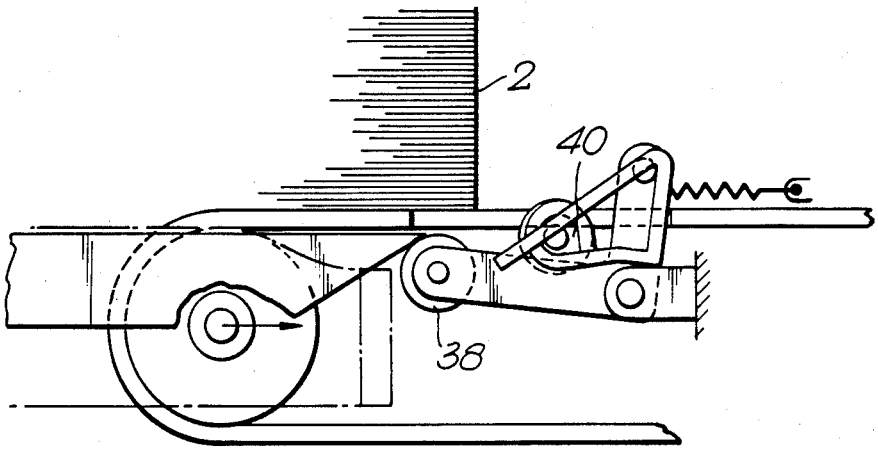
FIG. 6 is a diagrammatic view of one contemplated means for lifting the lower corner of a stack to prevent the sheets thereof being damaged by dropping into the gap between the two support belts.
Figure 7:
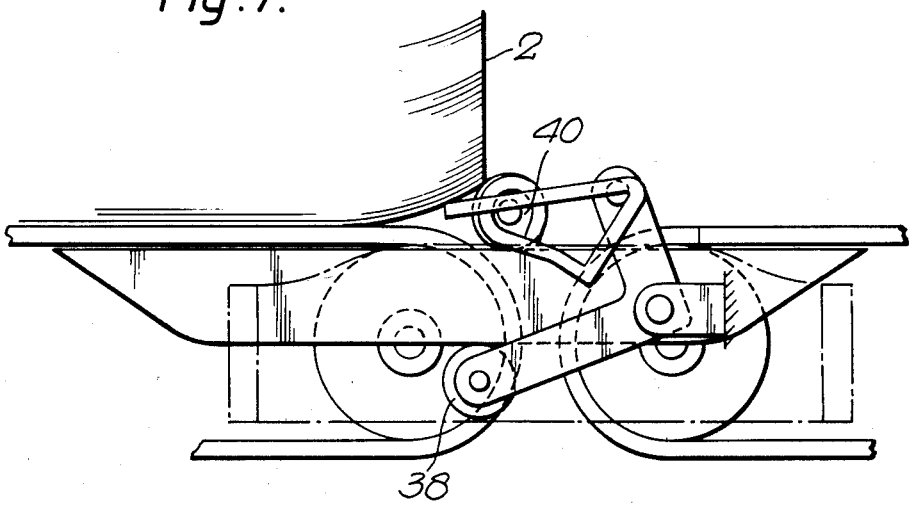
FIG. 7 is a view similar to FIG. 6 showing the corner lifting mechanism in a later operational position.

FIGS. 6 and 7 are side elevations showing how the cam followers 38 and 40 may have their operation controlled by two separate cams, which might be necessary if the vertical spacing between the peripheries of the cam followers is not sufficient to permit a double-edged cam to be used. In such a case, two cams would have to be used, with the cam followers displaced laterally so that each comes into contact with the cam face of only one of the two cams. Apart from this, the operation of the cams is essentially the same as already described.

Thus it will be seen that the present invention provides a bottom- fed stacker of simple instruction in which fresh sheets are pressed successively onto the bottom face of the stack, thus preserving the desired 1-to-N order of the stack from the top down, permitting the unloading of stacked sheets at any time without affecting in any way operation of the stacker.

Figure 8:
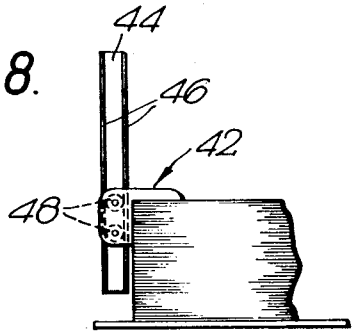
FIG. 8 is a diagrammatic view of one form of 'virtual' registration edge able to be used with the sheet stacker.

As an alternative to registration edges 13 and 20, the vertically-movable weight 42 shown in FIG. 8 may be used. It runs in a vertical guide 44 having parallel flanges 46 between which run a pair of rollers 48 carried by weight 42 in a low-friction arrangement. An upright surface of the weight acts as a registration edge, and the overlying limb transfers the mass of the weight to the stack, thus holding at least the first few sheets of the stack in place against the upright surface until the stack is thick enough for its own mass to hold it in place despite the feeding movements of the belts and rollers.

What is claimed is:

1. A sheet stacker which effectively stacks a wide variety of sheets including lightweight flimsy sheets, comprising: a pair of support belts with horizontal, coplanar, opposing upper runs, the belts each being anchored at one end and wound on a supply drum on the other end and entrained over a respective roller, said rollers translatable as a unit while being free to rotate, and which define between them an unobstructed feed gap for sheets to be applied seriatim to the bottom face of a stack of sheets resting on one or both belts; means for feeding sheets singly through the gap and into contact, within said gap with a registration edge and for holding the sheet in contact therewith as the rollers are translated, and wherein the forward end of the stack with respect to the direction in which the stack is translated becomes aligned with the registration edge as one belt is successively pulled away from the said bottom face and is replaced after an interval by the other belt having the fresh sheet on its upper face, thus successively pressing the fresh sheet against the bottom face of the stack to displace it upwardly by one sheet thickness.

2. A sheet stacker as claimed in claim 1, including at least one finger able to be positioned below a bottom corner of the stack of sheets only while the stack is within said gap so as to prevent sheets being displaced into the gap between the opposing belt runs as the gap is moved across the bottom face of the stack.

3. The sheet stacker claim 2, in which said registration edge is movable with at least one of said belts.

4. The sheet stacker of claim 3, including sheet stack edge clamp means separate from said belts and adapted to hold the first few sheets in a stack in position.

5. The sheet stacker of claim 3, in which said registration edge is positioned to one side of the stack for collating simplex copies by feeding motion of the rollers in one direction, and positioned to the other side of the stack for collating duplex copies by feeding motion in the opposite direction.

6. A sheet stacker as claimed in claim 1, in which there is no fixed part of the stacker overlying the top sheet in the stack, thereby permitting at least part of a stack to be removed manually from the stacker while it is operating.

7. A sheet stacker as claimed in claim 1, wherein said means for feeding sheets singly through said gap and into contact with said registration edge within said gap buckles said sheets against said registration edge in order to insure that when the respective roller starts to move, the sheet remains in contact with said registration edge.

8. A sheet stacker as claimed in claim 7, including guide means to limit said buckle of said sheets.

* * * * *